US009141075B2

(12) United States Patent
Choi et al.

(10) Patent No.: US 9,141,075 B2
(45) Date of Patent: Sep. 22, 2015

(54) IMAGE FORMING APPARATUS HAVING PIVOTABLE UPPER BODY

(75) Inventors: Dong-ha Choi, Suwon-si (KR); Kiel-jae Hur, Anyang-si (KR); Young-min Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/470,974

(22) Filed: May 14, 2012

(65) Prior Publication Data

US 2012/0224884 A1 Sep. 6, 2012

Related U.S. Application Data

(62) Division of application No. 12/049,487, filed on Mar. 17, 2008, now Pat. No. 8,200,117.

(30) Foreign Application Priority Data

Apr. 16, 2007 (KR) ..... 2007-37140
Sep. 13, 2007 (KR) ..... 2007-93284

(51) Int. Cl.
*G03G 21/00* (2006.01)
*G03G 21/16* (2006.01)

(52) U.S. Cl.
CPC ..... *G03G 21/1609* (2013.01); *G03G 21/1628* (2013.01); *G03G 2215/00016* (2013.01)

(58) Field of Classification Search
CPC ..... G03G 21/1628
USPC ..... 399/361
See application file for complete search history.

(56) References Cited

U.S. PATENT DOCUMENTS 5,206,681 A 4/1993 Otomo et al.
5,300,979 A 4/1994 Tsukakoshi et al.
5,499,086 A * 3/1996 Matsuno et al. ..... 399/313
5,768,659 A * 6/1998 Kameda ..... 399/111

(Continued)

FOREIGN PATENT DOCUMENTS

JP 01280783 A * 11/1989
JP 06156757 A * 6/1994

(Continued)

OTHER PUBLICATIONS

Chinese Office Action mailed Mar. 12, 2012 issued in corresponding Chinese Patent Application No. 200810092626.4.

(Continued)

*Primary Examiner* — Quana M Grainger
(74) *Attorney, Agent, or Firm* — Staas & Halsey LLP

(57) ABSTRACT

An image forming apparatus including: a first body including a developing unit to perform an image forming operation on a print medium, and a second body provided above the first body to pivot between a closed position and an open position in relation to the first body, the second body including a light emitting unit, wherein the light emitting unit is directly above the developing unit when the second body is in the closed position, and the developing unit is exposed to an outside of the image forming apparatus when the second body is in the closed position. A user can place the image forming apparatus on a desktop, which increases convenience in using the apparatus. Additionally, a specialized image forming apparatus can be provided to a user who mainly wants to print and copy in small quantities.

9 Claims, 8 Drawing Sheets

(56) References Cited

U.S. PATENT DOCUMENTS

| | | | | |
|---|---|---|---|---|
| 5,978,626 | A | 11/1999 | Nagamine et al. | |
| 6,064,498 | A | 5/2000 | Taniguchi et al. | |
| 6,121,985 | A | 9/2000 | Terada et al. | |
| 6,553,207 | B2 * | 4/2003 | Tsusaka et al. | 399/401 |
| 7,035,568 | B2 | 4/2006 | Sato et al. | |
| 7,416,178 | B2 | 8/2008 | Ito | |
| 2004/0022555 | A1 | 2/2004 | Sato et al. | |
| 2004/0170457 | A1 * | 9/2004 | Kamimura et al. | 399/388 |
| 2005/0281597 | A1 | 12/2005 | Ito | |
| 2006/0140670 | A1 | 6/2006 | Choi et al. | |
| 2006/0221170 | A1 * | 10/2006 | Sato et al. | 347/138 |
| 2008/0063450 | A1 * | 3/2008 | Choi | 399/388 |

FOREIGN PATENT DOCUMENTS

| | | |
|---|---|---|
| JP | 9-156184 | 6/1997 |
| JP | 2001-350391 | 12/2001 |
| JP | 2002-87684 | 3/2002 |
| JP | 2004-69884 | 3/2004 |
| JP | 2006-1141 | 1/2006 |

OTHER PUBLICATIONS

Office Action dated Mar. 29, 2011 in parent U.S. Appl. No. 12/049,487.

Korean Office Action issued on Jan. 10, 2014 in corresponding Korean Application No. 10-2007-0093284.

Chinese Office Action issued Nov. 3, 2014 in corresponding Chinese Patent Application No. 201310020729.0.

Notice of Allowance dated Feb. 13, 2012 in parent U.S. Appl. No. 12/049,487.

Office Action dated Oct. 7, 2011 in parent U.S. Appl. No. 12/049,487.

Office Action dated Sep. 28, 2010 in parent U.S. Appl. No. 12/049,487.

Office Action dated Mar. 9, 2011 in parent U.S. Appl. No. 12/049,487.

Chinese Office Action issued May 18, 2015 in corresponding Chinese Patent Application No. 201310020729.0.

* cited by examiner

IMAGE FORMING APPARATUS HAVING PIVOTABLE UPPER BODY

CROSS-REFERENCE TO RELATED APPLICATIONS

This is a divisional application of application U.S. Ser. No. 12/049,487, filed Mar. 17, 2008 now U.S. Pat. No. 8,200,117 in the United States Patent and Trademark Office, which claims benefit of Korean Application Nos. 2007-37140, filed Apr. 16, 2007, and 2007-93284, filed Sep. 13, 2007, in the Korean Intellectual Property Office, the disclosures of which are incorporated herein by reference.

BACKGROUND OF THE INVENTION

1. Field of the Invention

Aspects of the present invention relate to an image forming apparatus, and more particularly, to a compact image forming apparatus that can be used on a desktop.

2. Description of the Related Art

Generally, the size of an image forming apparatus is determined by the size of sheets of usable paper. Moreover, image forming apparatuses for use in offices are designed so that large capacity paper cassettes, network printing functions, and various sizes of paper can be used. As a result, the size of image forming apparatuses has increased.

On the other hand, image forming apparatuses for use in the home are designed for compactness and low noise rather than high speed and powerful functions, because such image forming apparatuses are used less frequently than image forming apparatuses for office use.

FIG. 1 illustrates a conventional multifunction peripheral (MFP) as an example of an image forming apparatus. The conventional MFP includes a scanning unit and a printing unit. Referring FIG. 1, the MFP includes a first body 10 in which the printing unit is mounted, and a second body 20 in which the scanning unit is mounted.

The first body 10 is configured such that, if needed, an electrophotographic type image forming apparatus or an inkjet type image forming apparatus may be provided. The first body 10 of FIG. 1, in which an electrophotographic type image forming apparatus is provided, includes a paper cassette 11, a pickup unit 12, a feeding unit 13, a developing unit 14, a transferring unit 15, a fixing unit 16, a discharging unit 17, and a light emitting unit 18.

The second body 20, which is provided above the first body 10, is the scanning unit and includes a plate 21 on which a document is placed, a charge coupled device (CCD) module 22 that is mounted on a bottom surface of the plate 21 so as to move from side to side, and a plate cover 23 that is designed to cover the plate 21.

However, the conventional MFP has been developed without taking into consideration the need for miniaturization. As a result, the dimensions of conventional MFPs are too large to fit on desktops. Accordingly, a separate space is required for the MFP, resulting in an inconvenience to a user.

SUMMARY OF THE INVENTION

Aspects of the present invention provide to a compact image forming apparatus suitable for desktop use.

According to an aspect of the present invention, there is provided an image forming apparatus including: a first body including a developing unit to perform an image forming operation on a print medium; and a second body provided above the first body to pivot between a closed position and an open position in relation to the first body, the second body including a light emitting unit, wherein the light emitting unit is directly above the developing unit when the second body is in the closed position, and the developing unit is exposed to an outside of the image forming apparatus when the second body is in the open position.

The second body may include a scanning unit, and a height of the first body may be approximately two or three times greater than that of the second body.

The first body may have a height of less than 125 mm, and the first and second bodies may have a combined height of less than 165 mm.

The first body may have a height of 110 mm to 125 mm, and the first and second bodies may have a combined height of 160 mm to 170 mm.

A weight of the first body may be greater than that of the second body.

The weight of the first body may be at least 1.5 to 2.5 times that of the second body.

An opening angle between the second body and the first body may be approximately 40° to 80°.

The first body may include a feeding unit, a developing unit, a transferring unit, a fixing unit and a discharging unit.

A print medium picked up by the feeding unit may be printed and discharged after a feeding direction is changed only once.

The direction in which the feeding unit slides open may be the same as the direction in which the print medium is discharged by the discharging unit.

The second body may include a scanning unit to scan a document.

The scanning unit may include: a plate on which the document is placed; a scanning module that moves from side to side on the plate, the scanning module being provided below the plate; and a plate cover that is pivotably attached to the second body by a hinge to cover the plate by movement around the hinge.

An initial position of the scanning module may be on a side opposite a hinge point at which the second body is attached to the plate cover by the hinge.

The first body may include a groove in which a print media support member is adapted to slide and which is formed in a portion in which the print medium is discharged.

According to another aspect of the present invention, there is provided an image forming apparatus including: a first body including a developing unit to perform an image forming operation on a print medium, and a feeding unit to stack print media and to feed the print medium toward the developing unit in a first direction; and a second body provided above the first body to pivot between a closed position and an open position in relation to the first body, the second body having a same width as the first body and including a scanning unit to scan a document and a light emitting unit, wherein the light emitting unit is directly above the developing unit when the second body is in the closed position, the developing unit is exposed to an outside of the image forming apparatus when the second body is in the open position, the feeding unit slides open in a second direction that is opposite the first direction, and the print medium is discharged from the first body in the second direction after the image forming operation is performed thereon.

The first body may have a height of 110 mm to 125 mm, and the first and second bodies may have a combined height of 160 mm to 170 mm.

A weight of the first body may be greater than that of the second body.

The weight of the first body may be at least 1.5 to 2.5 times greater than that of the second body.

As illustrated in FIG. 8, for example, an opening angle θ between the second body and the first body may be approximately 40° to 80°.

According to yet another aspect of the present invention, there is provided an image forming apparatus including: a first body including a developing unit to perform an image forming operation on a print medium, and a feeding unit to stack print media and to feed the print medium toward the developing unit in a first direction; and a second body provided above the first body to pivot between a closed position and an open position in relation to the first body, the second body including a scanning unit to scan a document, wherein the feeding unit slides open in a second direction that is opposite to the first direction, and the print medium is discharged from the first body in the second direction after the image forming operation is performed thereon.

According to still another aspect of the present invention, there is provided an image forming apparatus including a feeding unit to stack print media; a conveying roller 500 to convey the print media fed by the feeding unit; a transferring section to transfer an image onto the print media conveyed by the conveying roller 500; and a fixing section to fix the image transferred by the transferring section, wherein a route from the conveying roller 500 to the transferring section and/or a route from the transferring section to the fixing section enables the print media to be bent in a substantially reverse direction with respect to a print media route, which is reversed in the conveying roller 500.

The print media route may be substantially reversed adjacent to the conveying roller 500.

The fixing section may be disposed in a gap between the transferring section and an upper portion of the conveying roller 500.

The upper portion of the conveying roller 500 may be disposed above the transferring section and the fixing section.

The image forming apparatus may further include a discharging unit to discharge the print media conveyed through the fixing section. The discharging unit may be disposed in the same direction as that in which the print media is conveyed from the transferring section to the fixing section.

A photoconductive medium may face a transferring unit in the transferring section, and a heating device may face a pressing device in the fixing section. If the photoconductive medium is disposed above the transferring unit, the rigidity of the photoconductive medium may be greater than that of the transferring unit, and if the photoconductive medium is disposed below the transferring unit, the rigidity of the photoconductive medium may be less than that of the transferring unit. If the heating device is disposed above the pressing device, the rigidity of the heating device may be greater than that of the pressing device, and if the heating device is disposed below the pressing device, the rigidity of the heating device may be less than that of the pressing device.

The discharging unit may include a print media support member to stack the print media conveyed through the fixing section.

The image forming apparatus may further include a groove in which a print media support member is adapted to slide.

The image forming apparatus may further include a device to open the groove when the print media support member is attached, and to close the groove when the print media support member is detached.

The image forming apparatus may further include an elastic member disposed adjacent to the device.

According to still another aspect of the present invention, there is provided an image forming apparatus including a feeding unit to stack print media; a conveying roller to convey the print media fed by the feeding unit; a transferring section to transfer an image onto the print media conveyed by the conveying roller; and a fixing section to fix the image transferred by the transferring section, wherein the upper portion of the conveying roller is disposed above the transferring section and the fixing section.

The fixing section may be disposed above the transferring section.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiment, taken in conjunction with the accompanying drawings of which.

DETAILED DESCRIPTION OF THE EMBODIMENTS

Figure 1:
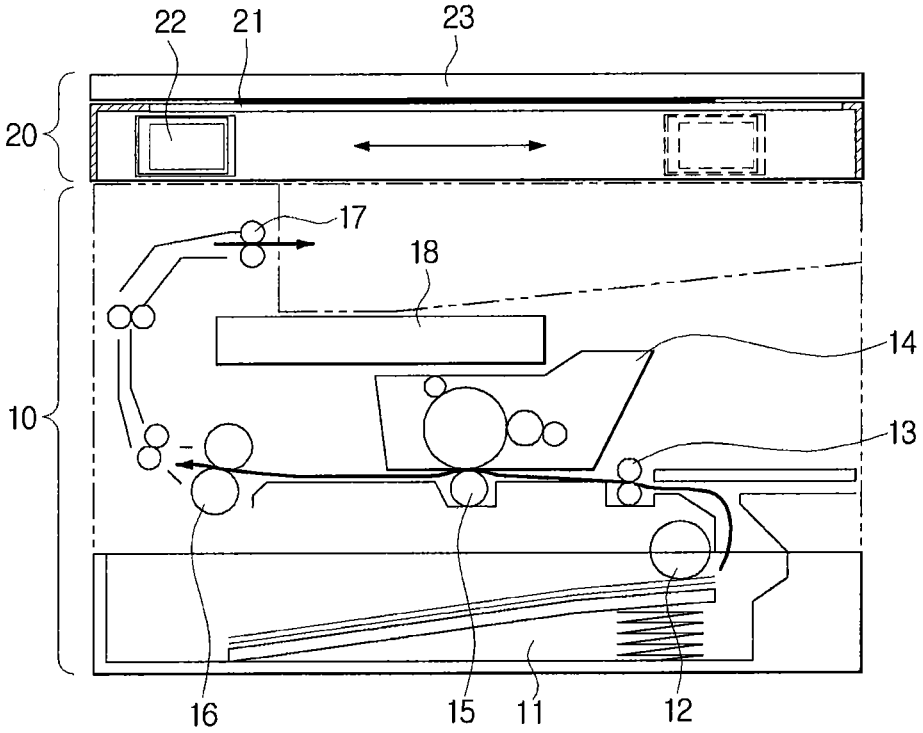
FIG. 1 (PRIOR ART)
FIG. 1 is a schematic view of a conventional multifunction peripheral (MFC)

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
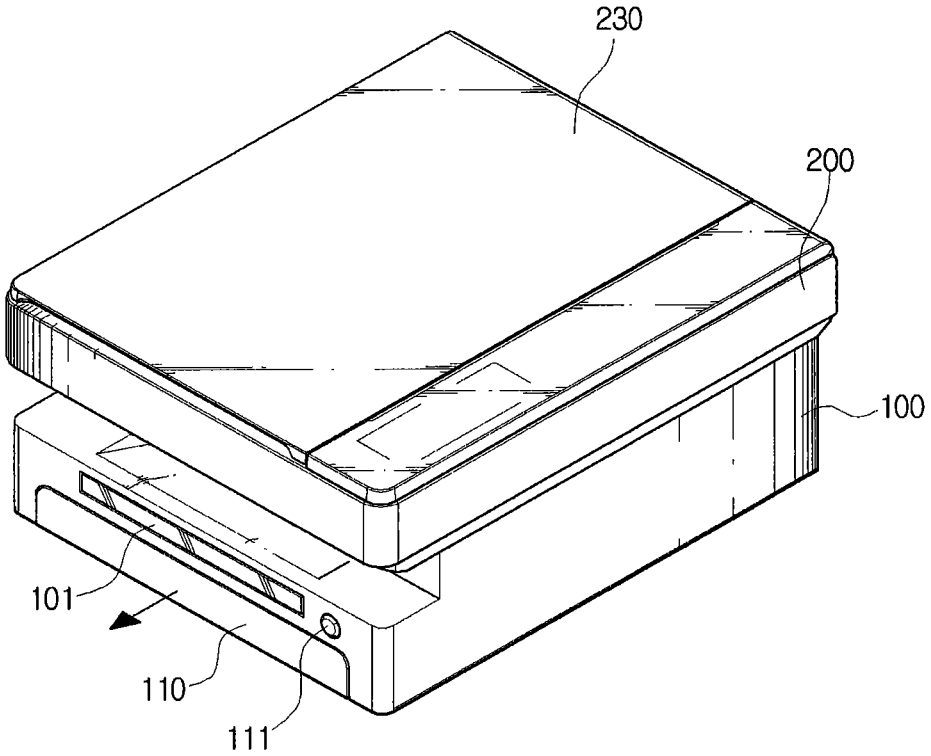
FIG. 2 is a perspective view of an image forming apparatus according to an embodiment of the present invention.
Figure 3:
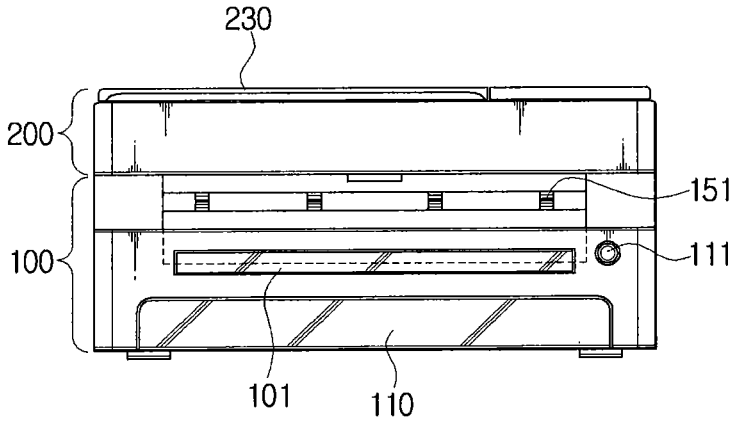
FIG. 3 is a front view of the image forming apparatus shown in FIG. 2.
Figure 4:
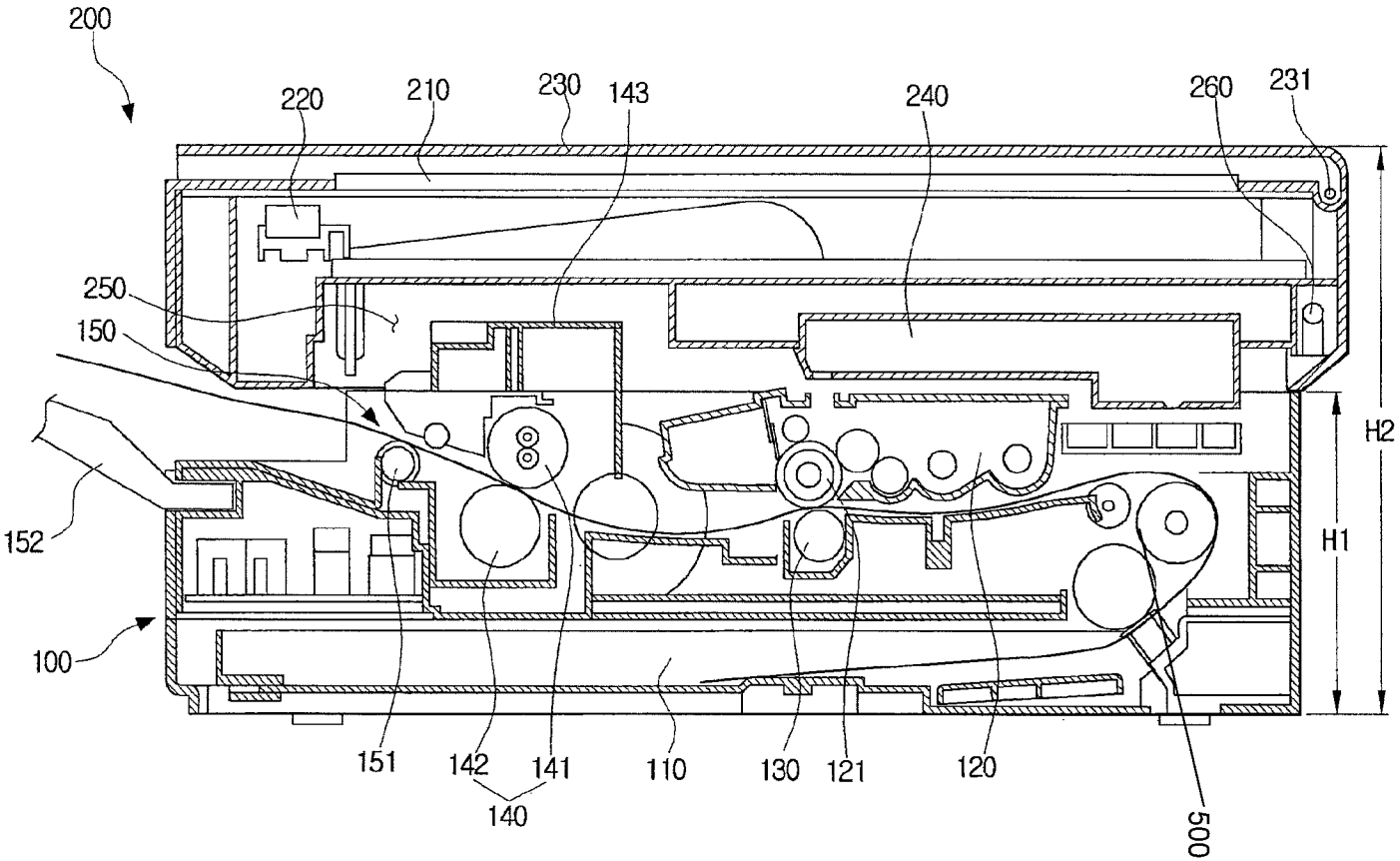
FIG. 4 is a side view of the image forming apparatus shown in FIG. 2.

FIG. 2 is a perspective view of an image forming apparatus according to an embodiment of the present invention, FIG. 3 is a front view of the image forming apparatus shown in FIG. 2, and FIG. 4 is a side view of the image forming apparatus shown in FIG. 2. Referring to FIGS. 2 through 4, the image forming apparatus includes a first body 100 and a second body 200.

The first body 100 includes a printing unit mounted therein, a feeding unit 110, a developing unit 120, a transferring unit 130, a fixing unit 140 and a discharging unit 150. The feeding unit 110 is mounted on the first body 100 so as to slide open when a button 111 is pressed. However, it is understood that according to other aspects, other methods and devices may be used to slide the feeding unit 110 out. For example, the feeding unit 110 may include a handle such that the feeding unit 110 is manually slid out by pulling the handle. Furthermore, the feeding unit 110 holds a plurality of sheets of print media. The print media is any media on which an image forming apparatus prints. For example, the print media may be paper or transparency sheets. In order to reduce the height of the image forming apparatus, the feeding unit 110 may, although not necessarily, hold approximately 100 sheets of print media.

As shown in FIG. 4, the developing unit 120 is detachably mounted on the first body 100, and prints an image on a surface of a print medium while rotating in close contact with the transferring unit 130. A photoconductive medium 121 mounted in the developing unit 120 may, although not necessarily, have a diameter of approximately 20 mm in order to minimize a size of the image forming apparatus.

The fixing unit 140 includes a heating roller 141 and a pressing roller 142. The fixing unit 140 applies heat and pressure to the print medium passing through the developing unit 120 and the transferring unit 130, and fixes the image on the surface of the print medium. A heat insulating member 143 is mounted above the fixing unit 140 to prevent heat emitted from the fixing unit 140 from being transmitted to the second body 200.

The discharging unit 150 includes a plurality of roller units 151 provided in positions adjacent to the fixing unit 140. The discharging unit 150 discharges sheets of print medium passing through the fixing unit 140 towards a front portion of the first body 100. The front portion of the first body 100 is a portion from which the feeding unit 110 may be detached and the printed sheets of print media may be discharged.

The discharged sheets of print media may drop onto a surface on which the first body 100 is provided, or may be dropped on to a print media support member 152 that is mounted on the front portion of the first body 100 (as shown in FIG. 4). The print media support member 152 is adapted to slide in a groove 101 (illustrated in FIGS. 2 and 3) provided in the front portion of the first body 100.

Figure 7A:
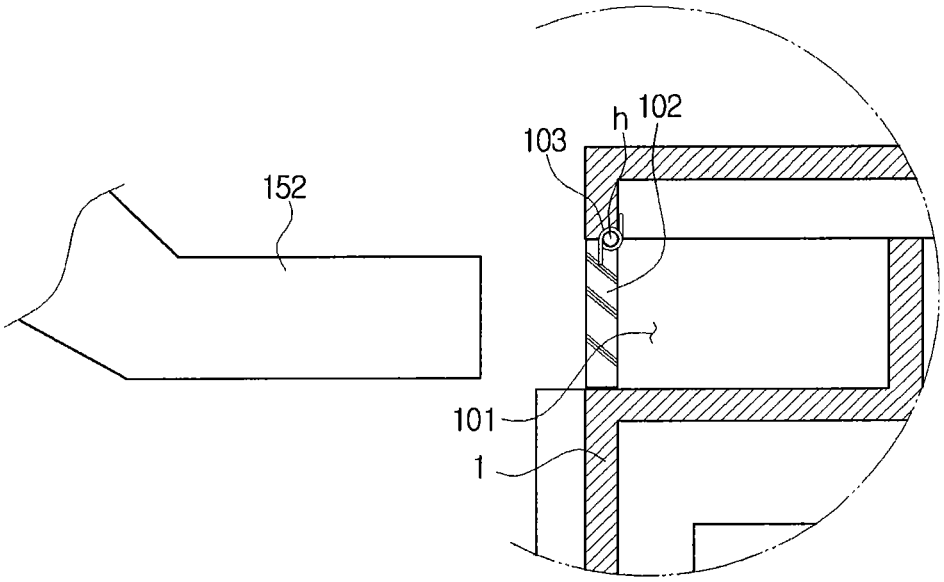
FIGS. 7A to 7D are views of a print media support member of the image forming apparatus shown in FIG. 5.
Figure 7B:
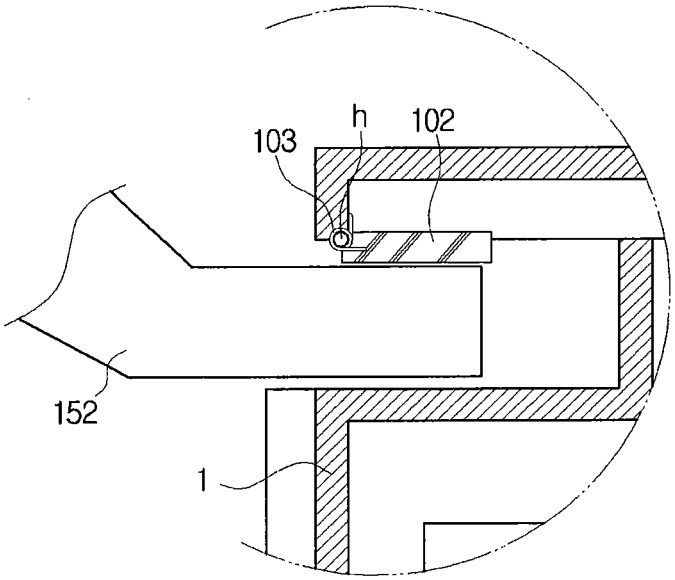

As shown in FIGS. 7A to 7B, the print media support member 152 may be attached onto the groove 101 provided in the front portion of an external frame 1 of the first body 100. Additionally, a cover 102 may be included in an inlet of the groove 101 to elastically open and close the groove 101. Here, the elastic movement of the cover 102 may be made by an elastic member 103, such as a leaf spring or a coil spring, which is connected to the cover 102 and has an elastic force.

If the elastic member 103 is disposed above the cover 102, as shown in FIGS. 7A and 7B, the print media support member 152 may be inserted from the left upper side to the right lower side, so it is possible to open and close the groove 101 by the movement of the cover 102 without separately having the elastic member 103. In this situation, a hinge point h may be disposed in the upper side in order to rotate the cover 102.

Figure 7C:
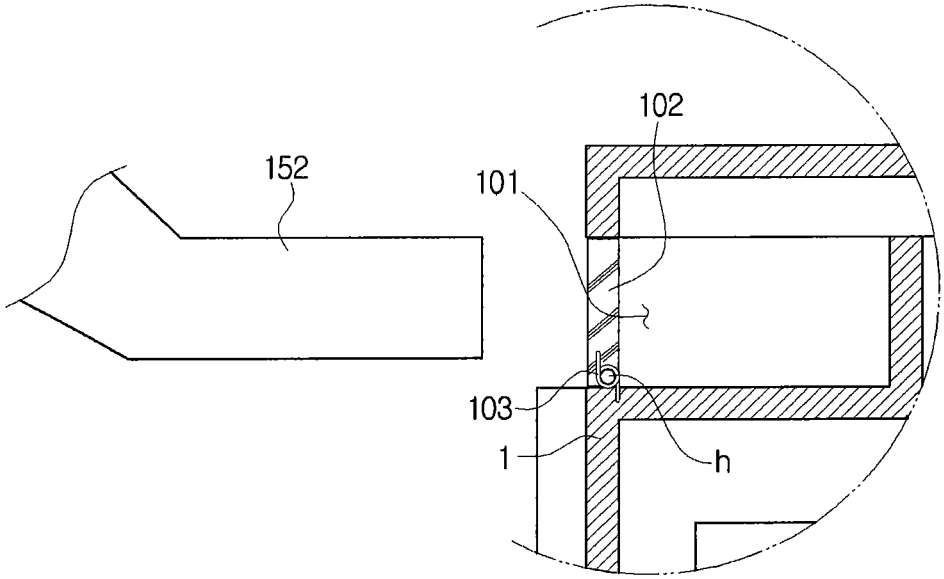
Figure 7D:
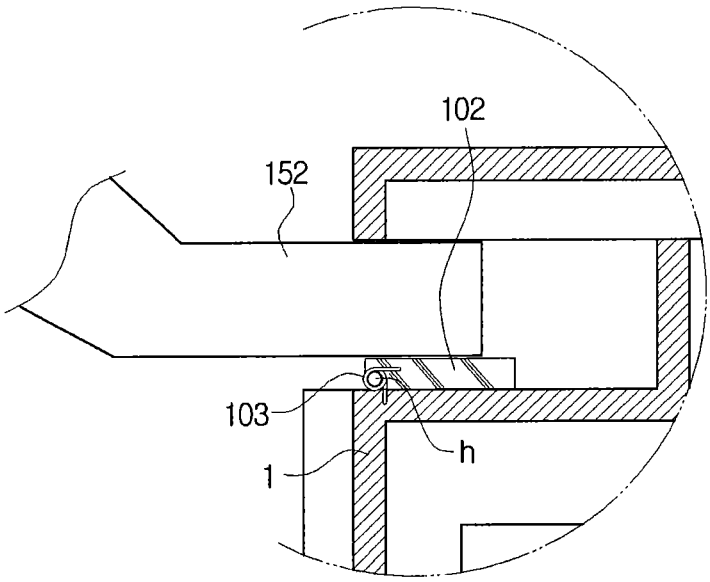
Figure 8:
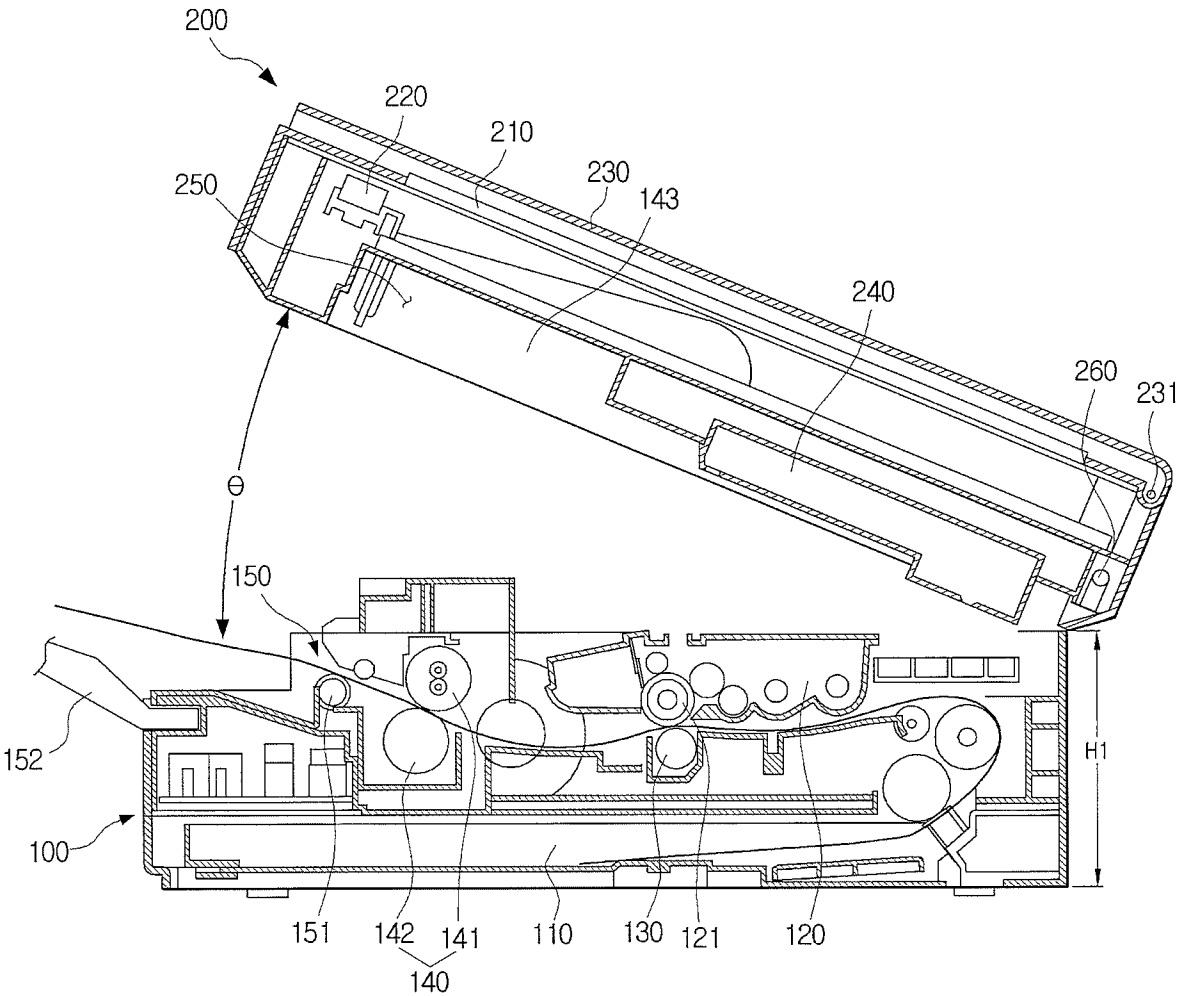
FIG. 8 is a side view of an exemplary embodiment of the image forming apparatus illustrated in FIG. 4 in an example open position.

Alternatively, if the elastic member 103 is disposed below the cover 102, as shown in FIGS. 7C and 7D, it is difficult for the cover 102 to return to the original position itself, so the elastic member 103 is required.

As shown in FIG. 4, the developing unit 120, transferring unit 130, fixing unit 140 and discharging unit 150 are mounted in order above the feeding unit 110, and form a C-shaped print medium feeding path toward the front portion of the first body 100. Accordingly, the direction in which the feeding unit 110 slides open may be the same as the direction in which the print medium is discharged by the discharging unit 150. Thus, it is possible to reduce the height H1 of the first body 100 by removing unnecessary space in the interior of the first body 100.

Referring to FIGS. 2 through 4, the second body 200 includes a light emitting unit 240 and a scanning unit including a plate 210, a scanning module 220, and a plate cover 230. Additionally, the second body 200 has the same width as the first body 100, and is mounted to pivot open and closed on the first body 100.

The plate 210 is made of a light permeable material, such as glass. The scanning module 220 is mounted so as to be able to be moved from side to side on the bottom surface of the plate 210. The plate cover 230 is mounted to pivot open and closed on the second body 200 and a hinge point 231. The initial position of the scanning module 220 is on a side of the second body 200 opposite that of the hinge point 231 (as shown in FIG. 4). Accordingly, the scanning module 220 may scan images of documents placed on the plate 210. Specifically, the initial position of the scanning module 220 may be provided in the front portion of the second body 200, and the hinge point 231 may be provided in the rear portion of the second body 200. However, it is understood that according to other aspects, the scanning module 220 may be initially provided in a middle portion of the second body 200 or on a same side of the second body 200 as the hinge point 220.

If the initial position of the scanning module 220 is on the front portion of the second body 200, a document may be placed on the plate 210 in the front portion of the second body 200. Accordingly, the hinge point 231 of the cover 230 may have a simple configuration, and an angle between the plate 210 and the cover 230 can be reduced when the cover 230 is closed to cover the document.

The light emitting unit 240 is mounted in an open space of a lower part of the second body 200 and exposes the photoconductive medium 121 of the developing unit 120 mounted in the first body 100. Thus, because the light emitting unit 240 is mounted in a remaining open space of the second body 200, the height of the image forming apparatus can be less than that of an apparatus in which the light emitting unit 240 is mounted in the first body 100.

A portion of the second body 200 that faces the fixing unit 140 is provided to cover the fixing unit 140. That is, the fixing unit 140 protrudes upwardly (towards the second body 200) from the first body 100 because the heat insulating member 143 is mounted thereon. Accordingly, the second body 200 includes a housing groove 250 provided to face the fixing unit 140 in order to house the fixing unit 140.

An opening angle between the second body 200 and the first body 100 may, although not necessarily, be approximately 40° to 80. If the opening angle is too small, a user may experience inconvenience when removing jammed paper. Conversely, if the opening angle is too large, a hinge portion 260 that rotatably connects the first body 100 and the second body 200 may break due to the weight of the second body 200.

In order to prevent the image forming apparatus from flipping due to inertia caused by the weight of the second body 200 when opening the second body 200, the height H1 of the first body 100 may be greater than that of the second body 200 (for example, approximately two to three times greater). The first body 100 may, although not necessarily have a height H1 less than 125 mm, and the first body 100 and the second body 200 may, although not necessarily, have a combined height H2 less than 165 mm. For example, the first body 100 may have a height H1 less than 114 mm, and the first body 100 and the second body 200 may have a combined height H2 of less than 163 mm. Furthermore, to prevent flipping, the weight of the first body 100 may be greater than that of the second body 200 (for example, by a magnitude of at least 1.5 to 2.5 times greater).

The direction in which the feeding unit 110 slides open, the direction in which the print media housed in the feeding unit 110 is discharged, and the direction in which the scanning unit 220 moves from side to side may be the same. Accordingly, when a user prints or copies on a second side of a paper (on which printing has already been performed on a first side), the user can conveniently use the image forming apparatus without confusion.

Figure 5:
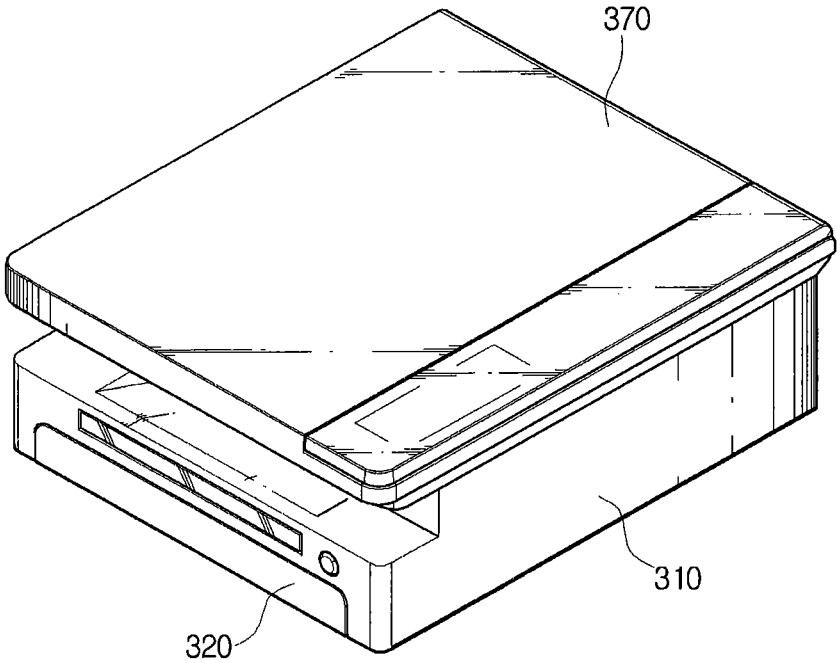
FIG. 5 is a perspective view of an image forming apparatus according to another embodiment of the present invention.
Figure 6:
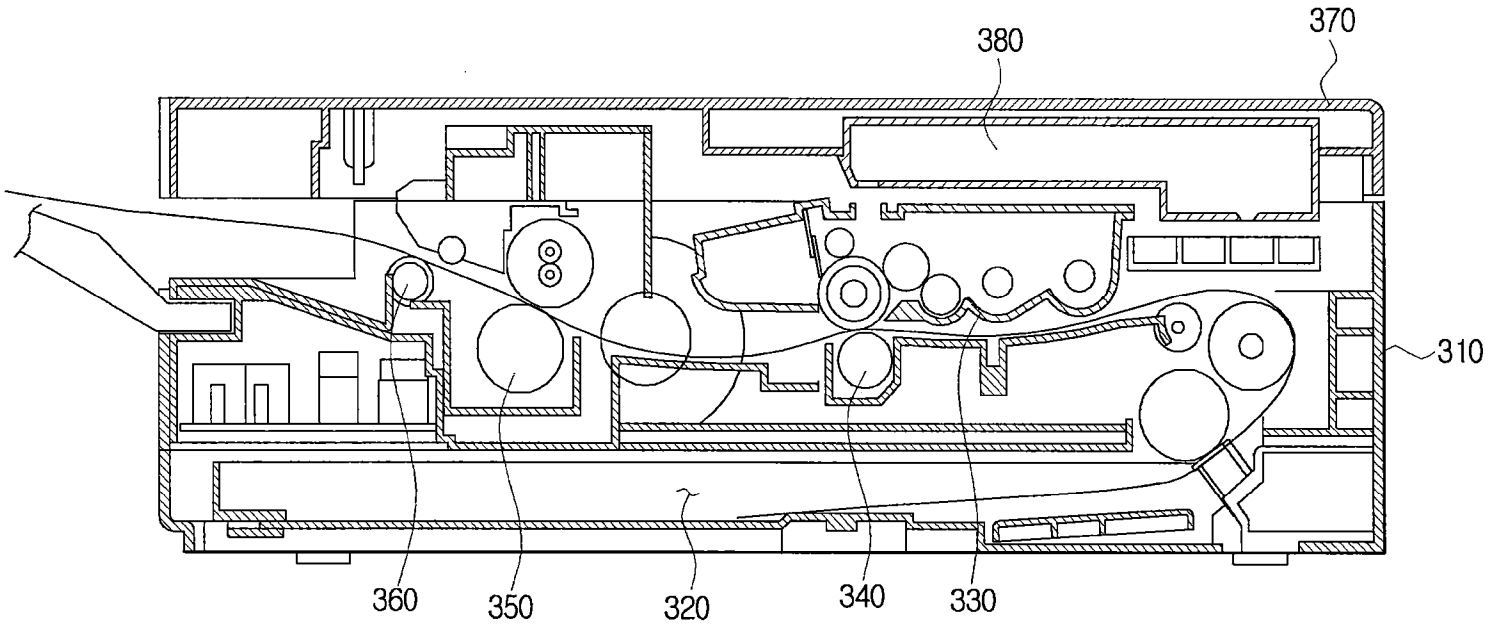
FIG. 6 is a side view of the image forming apparatus shown in FIG. 5.

It is understood that aspects of the present invention can be applied to an image forming apparatus including only a printing unit without scanning and copying functions. FIGS. 5 and 6 illustrate an image forming apparatus according to another embodiment of the present invention, implemented without the second body 200 as described above with reference to FIGS. 2 through 4. Referring to FIG. 5, the image forming apparatus includes a main body 310, a feeding unit 320, a developing unit 330, a transferring unit 340, a fixing unit 350, a discharging unit 360, and a cover 370 that is mounted to open and close in order to, for example, remove jammed paper or maintain the above mentioned components. The cover 370 includes a light emitting unit 380 mounted therein. The main body 310 may, although not necessarily, have a height of less than 125 mm. The main body 310 has the same configuration as the first body 100 described with reference to FIGS. 2 through 4, so a description thereof is omitted here.

Hereinafter, operations of the image forming apparatus according to aspects of the present invention will be described. Referring to FIG. 4, the image forming apparatus according to an embodiment of the present invention includes a first body 100 in which the printing unit is mounted, and a second body 200 in which the scanning module 220 is mounted. The second body 200 may be opened and closed from the first body 100 (i.e., pivoting up and down from the first body 100).

In order to reduce the height of the first body 100, a C-shaped paper feeding path is provided to change a paper feeding direction once. Specifically, a developing unit 120, a transferring unit 130, a fixing unit 140, and a discharging unit 150 are arranged in order above the feeding unit 110 to provide the C-shaped paper feeding path. Accordingly, the first body 100 may have height H1 of less than 125 mm, and the first body 100 and the second body 200 may have height H2 of less than 165 mm. As a result, the image forming apparatus can be directly mounted on a desktop, for example, without a separate space required.

The image forming apparatus having a low height as described above may be placed conveniently from a user (for example, directly on a desktop), so it is not necessary for the user to travel a far or inconvenient distance to a position in which the image forming apparatus is placed in order to perform copying, scanning, and/or printing. Additionally, the print medium may be printed on so that a printed surface is visible upon discharge, making it possible to immediately check the printing results. Furthermore, the user may stack print media by attaching a print media support member 152 onto a groove 101 (as illustrated in FIG. 4), if needed, or may allow the output print media to be piled on a surface on which the image forming apparatus is mounted.

If paper jamming occurs during printing or copying, or if maintenance of the developing unit 120 or the fixing unit 140 is needed, the user may lift the second body 200 so that the developing unit 120 and the fixing unit 140 are exposed and easily accessible.

The first body 100 has a height and/or a weight greater than the second body 200, so it is possible to prevent the image forming apparatus from flipping due to inertia during rotation of the second body 200 when the user opens the second body 200. Additionally, the opening angle between the first body 100 and the second body 200 may be approximately 45°. Accordingly, a user can easily reach into a gap between the first body 100 and the second body 200 to change the developing unit 120 or to remove jammed paper. In addition, it is possible to prevent the second body 200 or the hinge portion 260 connecting the first body 100 and the second body 200 from being broken due to excessive opening of the second body 200.

As illustrated in FIGS. 5 and 6, the image forming apparatus according to another embodiment of the present invention does not include the second body 200 having the scanning unit.

According to aspects of the present invention described above, a user can conveniently place an image forming apparatus (for example, on a desktop), and accordingly, the user can more conveniently operate the image forming apparatus. Additionally, a specialized image forming apparatus can be provided to a user who primarily prints or copies in small quantities.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a body;

a feeding unit to stack print media, the feeding unit disposed inside the body;

a conveying roller to convey the print media from the feeding unit;

a transferring section to transfer an image onto the print media conveyed by the conveying roller, the transferring section disposed over the feeding unit;

a fixing section to fix the image transferred by the transferring section; and a discharging unit to discharge the print media conveyed through the fixing section in a rear-to-front direction of the body that is the same as the rear-to-front direction the print media is conveyed from the transferring section to the fixing section, wherein a route from the conveying roller to the transferring section and/or a route from the transferring section to the fixing section enables the print media to be bent in a substantially reverse direction with respect to a print media route, which a print media travel direction is reversed in the conveying roller, wherein the fixing section is disposed above the transferring section, wherein the print media travel direction is angled downwards exiting the conveying roller and angled upwards entering the transferring section, and wherein the discharging unit comprises a print media support member to stack the print media conveyed through the fixing section and a groove in which a print media support member is adapted to slide.

2. The apparatus as claimed in claim 1, wherein the print media route is substantially reversed adjacent to the conveying roller.

3. The apparatus as claimed in claim 1, wherein the fixing section is disposed in a gap between the transferring section and an upper portion of the conveying roller.

4. An image forming apparatus comprising:

a body;

a feeding unit to stack print media, the feeding unit disposed inside the body;

a conveying roller to convey the print media from the feeding unit;

a transferring section to transfer an image onto the print media conveyed by the conveying roller, the transferring section disposed over the feeding unit;

a fixing section to fix the image transferred by the transferring section; and a discharging unit to discharge the print media conveyed through the fixing section in a direction in which the print media is conveyed from the transferring section to the fixing section, wherein a route from the conveying roller to the transferring section and/or a route from the transferring section to the fixing section enables the print media to be bent in a substantially reverse direction with respect to a print media route, which the print media travel direction is reversed in the conveying roller, wherein the fixing section is disposed above the transferring section, wherein the upper portion of the conveying roller is disposed above the transferring section, wherein the print media is conveyed in a rear-to-front direction of the body from the transferring section to the fixing section, and conveyed in the rear-to-front direction from the fixing section to the discharging unit, and wherein the discharging unit comprises a print media support member to stack the print media conveyed through the fixing section and a groove in which a print media support member is adapted to slide.

5. The apparatus as claimed in claim 4, wherein a photoconductive medium faces a transferring unit in the transferring section, and a heating device faces a pressing device in the fixing section, wherein, if the photoconductive medium is disposed above the transferring unit, the rigidity of the photoconductive medium is greater than that of the transferring unit, and if the photoconductive medium is disposed below the transferring unit, the rigidity of the photoconductive medium is less than that of the transferring unit; and if the heating device is disposed above the pressing device, the rigidity of the heating device is greater than that of the pressing device, and if the heating device is disposed below the pressing device, the rigidity of the heating device is less than that of the pressing device.

6. The apparatus as claimed in claim 4, further comprising a device to open the groove when the print media support member is attached, and to close the groove when the print media support member is detached.

7. The apparatus as claimed in claim 6, further comprising an elastic member disposed adjacent to the device.

8. An image forming apparatus comprising:

a body;

a feeding unit to stack print media, the feeding unit disposed inside the body;

a conveying roller to convey the print media from the feeding unit;

a transferring section to transfer an image onto the print media conveyed by the conveying roller, the transferring section disposed over the feeding unit;

a fixing section to fix the image transferred by the transferring section; and a discharging unit to discharge the print media conveyed through the fixing section in a rear-to-front direction of the body that is the same as the rear-to-front direction the print media is conveyed from the transferring section to the fixing section, wherein the upper portion of the conveying roller, and the discharging unit are disposed above the transferring section, wherein a print media travel direction is angled downwards exiting the conveying roller and angled upwards entering the transferring section, and wherein the discharging unit comprises a print media support member to stack the print media conveyed through the fixing section and a groove in which a print media support member is adapted to slide.

9. The apparatus as claimed in claim 8, wherein the fixing section is disposed above the transferring section.

* * * * *